US006140888A

United States Patent [19]

Särkkä et al.

[11] Patent Number: 6,140,888

[45] Date of Patent: Oct. 31, 2000

[54] METHOD AND STRUCTURE FOR TUNING THE SUMMING NETWORK OF A BASE STATION

[75] Inventors: Veli-Matti Särkkä, Oulunsalo; Timo Ahonpää, Oulu, both of Finland

[73] Assignee: Nokia Telecommunications Oy, Espoo, Finland

[21] Appl. No.: 09/171,443

[22] PCT Filed: Aug. 27, 1997

[86] PCT No.: PCT/FI97/00494

§ 371 Date: Oct. 20, 1998

§ 102(e) Date: Oct. 20, 1998

[87] PCT Pub. No.: WO98/09348

PCT Pub. Date: Mar. 5, 1998

[30] Foreign Application Priority Data

Aug. 29, 1996 [FI] Finland ..... 963377

[51] Int. Cl.[7] ..... H01P 5/12

[52] U.S. Cl. ..... 333/126; 333/127; 333/160; 333/260; 439/578

[58] Field of Search ..... 333/100, 123, 333/126, 127, 134, 219.1, 230, 254, 256, 260, 33, 160; 439/578

[56] References Cited

U.S. PATENT DOCUMENTS

| | | | |
|---|---|---|---|
| 2,900,610 | 8/1959 | Allen et al. | 333/35 |
| 3,150,247 | 9/1964 | White | 333/260 X |
| 3,697,893 | 10/1972 | Faustlin et al. | 333/230 X |
| 4,375,622 | 3/1983 | Hollingsworth et al. | 333/126 |
| 4,497,030 | 1/1985 | Bowling et al. | 364/481 |
| 4,667,172 | 5/1987 | Longshore et al. | 333/134 |
| 4,741,702 | 5/1988 | Yasumoto | 333/160 X |
| 4,763,090 | 8/1988 | Pitschi | 333/260 |
| 4,772,223 | 9/1988 | Yasumoto | 333/160 X |
| 4,902,991 | 2/1990 | Ishikawa et al. | 333/134 X |
| 5,167,510 | 12/1992 | Plummer | 439/52 |
| 5,440,281 | 8/1995 | Wey et al. | 333/126 |
| 5,689,219 | 11/1997 | Piirainen | 333/127 |
| 5,801,600 | 9/1998 | Butland et al. | 333/127 |
| 5,831,490 | 11/1998 | Särkkä et al. | 333/126 |

FOREIGN PATENT DOCUMENTS

| | | |
|---|---|---|
| 1413021 | 11/1975 | United Kingdom . |
| WO 92/20116 | 11/1992 | WIPO . |
| WO 96/00989 | 1/1996 | WIPO . |
| WO 96/08848 | 3/1996 | WIPO . |
| WO 97/02616 | 1/1997 | WIPO . |

OTHER PUBLICATIONS

A copy of the International Search Report for PCT FI97/00494, Dec. 1997.

*Primary Examiner*—Robert Pascal
*Assistant Examiner*—Barbara Summons
*Attorney, Agent, or Firm*—Altera Law Group

[57] ABSTRACT

The invention relates to a summing member comprising in-connectors for receiving and combining different RF signals and an out-connector for supplying the combined signals further, at least one of the connectors being coaxial and comprising an elongated rod-like inner conductor, and an outer conductor surrounding the rod-like inner conductor. To provide an adjustable summing point, said at least one connector comprises a moveable part of low-loss dielectric material or ferrimagnetic material, the part surrounding at least the inner conductor and being moveable lengthwise of the inner conductor so as to adjust the phase angle of a wave reflecting from the connector.

3 Claims, 1 Drawing Sheet

METHOD AND STRUCTURE FOR TUNING THE SUMMING NETWORK OF A BASE STATION

BACKGROUND OF THE INVENTION

The invention relates to a method of tuning a summing network of a base station, the summing network comprising: filter means with means for receiving signals supplied by radio transmitters of the base station, for filtering the signals, and for forwarding the filtered signals; and a summing member with in-connectors for receiving and combining the signals supplied by the filters, and an out-connector for supplying the combined signals to antenna means of the base station. The invention also relates to a base station of a radio system comprising: at least two transmitters; filter means, each one of which is connected to the output of the corresponding transmitter so as to filter the signals obtained from the output of the transmitter concerned and to supply the filtered signals further; and a summing member with in-connectors, each one of which is connected to the output of the corresponding filter so as to receive and combine the filtered signals, and an out-connector for supplying the combined signals to antenna means of the base station, at least one of the connectors of the summing member being coaxial and comprising an elongated rod-like inner conductor and a substantially tubular outer conductor surrounding the rod-like inner conductor. The invention further relates to a summing member comprising: in-connectors for receiving and combining at least two different RF signals, and an out-connector for supplying the combined signals further, whereby at least one of the connectors is coaxial and comprises an elongated rod-like inner conductor and a substantially tubular outer conductor surrounding the rod-like inner conductor.

The invention particularly relates to a summing network of combiner filters of a base station in a cellular radio system. A combiner filter is a narrowband band-pass filter in resonance with (tuned to) the carrier frequency of a transmitter connected to it. The adjustment range of the filters is usually 2–10% of the medium frequency. The signals obtained from the outputs of the combiner filters are summed by the summing network of the base station and supplied to the antenna of the base station. The summing network usually comprises a coaxial cable which leads to the antenna of the base station and to which the combiner filters are connected. In order that a maximum amount of the transmission power of the transmitters could transfer to the antenna, the summing network must be tuned to the frequency channels used by the transmitters of the base station. To be exact, the summing network is tuned at only one frequency, but with movement away from the optimum frequency, the mismatch will not rise strikingly at first. In the base stations of cellular radio systems, the summing network can thus usually be used at a frequency band with a width of about 1 to 3% of the medium frequency of the frequency band.

Tuning of previously known summing networks is based on the use of transmission lines of a precise, defined length, proportional to the wavelength. This sets high requirements to the cabling of a summing network, since the transmission lines must be of exactly the correct length so as to optimize the summing network to the correct frequency. As the operating frequency grows, the wavelength is reduced, and so is the length of the summing network. The requirements of tolerance set to the manufacture of branches of a summing network thereby increase so that it becomes impossible—or at least very expensive—to manufacture cables of a precise length. Also, as automatically (remote control) adjustable combiner filters have become more common, a need has arisen to change the tuning of the summing network in a simple and quick manner. The useful frequency band of the summing network is in practice so narrow that the frequency channels of the transmitters of the base station can hardly be changed at all if the tuning of the summing network is not adjusted as well. The previously known solution in which an installer goes to a base station site to replace the cabling of the summing network with cabling designed for a new frequency band is naturally too expensive and takes time.

SUMMARY OF THE INVENTION

The object of the invention is to provide a solution to the above problem and to provide a method by which the summing network can be tuned more quickly, easily and accurately. The object will be achieved by the method of the invention, which is characterized by adjusting the phase angle of a wave reflecting from at least one connector of the summing member so as to tune the summing network.

The invention also relates to a base station in which the method of the invention can be applied. The base station of the invention is characterized in that said at least one connector comprises a moveable part of low-loss dielectric material or ferrimagnetic material, the part surrounding at least the inner conductor and being moveable lengthwise of the inner conductor so as to adjust the phase angle of a wave reflecting from the connector.

The invention further relates to a summing member by which the method of the invention can be applied and which is useful in a base station according to the invention. The summing member according to the invention is characterized in that said at least one connector comprises a moveable part of low-loss dielectric material or ferrimagnetic material, the part surrounding at least the inner conductor and being moveable lengthwise of the inner conductor so as to adjust the phase angle of a wave reflecting from the connector.

The invention is based on the idea that arranging of at least one adjustable connector in the summing member (star point) of the summing network makes it possible to compensate for the wavelength error that is generated at different medium frequencies in the summing network and causes a phase angle difference between the propagating and reflecting waves in the summing network. When the adjustable connector is provided by arranging around the inner conductor of the coaxial structure a moveable part that is made of low-loss dielectric material or ferrimagnetic material and surrounds at least the inner conductor, the phase angle of the reflection coefficient S11 of the summing branch is easy to change. When the phase angle of the reflection coefficient S11 as seen from the summing point is adjusted to zero at the frequency used, the electric length of the summing network is exactly correct, i.e. $n*\lambda/4$. The primary advantages of the solution according to the invention are that the adjustment is easy and quick to carry out and that cables of a precise predefined length are no longer needed, which saves costs.

The slope of the adjustment in the invention can be designed to be as desired, for example by using material with a suitable dielectric constant. The higher the relative permittivity $\epsilon r$ of the moveable part, the bigger errors of length can be compensated for by the adjustable connector.

When a similar adjustable structure is arranged in each connector of the summing point, each individual branch of the summing network can be easily and quickly tuned exactly right, irrespective of the tuning of the other branches.

The invention also allows simple implementation of an automatically adjustable summing network. Each branch of the summing network can then automatically adjust to the medium frequency of the band-pass filter of the branch in question, or each branch can be simultaneously adjusted to the narrow frequency band to which all the band-pass filters are tuned. The adjustment of individual branches of the summing network can here be based e.g. on measurement of the reflected power. The adjustment of the connector belonging to a defined branch of the summing member is then modified until the reflected power reaches the minimum value, i.e. a maximum amount of the power supplied by the transmitter transfers to the antenna of the base station. The use of an automatically adjusting summing network makes it possible for the operator, for example, to change the frequency channels used by the base station by remote control from the network management centre without that an installer needs to go to the base station site to re-tune the summing network, as is the case in prior art solutions.

The preferred embodiments of the method, base station, and summing member according to the invention appear from the attached dependent claims 2, 4, 5, and 7.

BRIEF DESCRIPTION OF THE DRAWINGS

In the following the invention will be described in greater detail by means of a preferred embodiment serving as an example, with reference to the attached drawings in which.

DETAILED DESCRIPTION OF THE INVENTION

Figure 1:
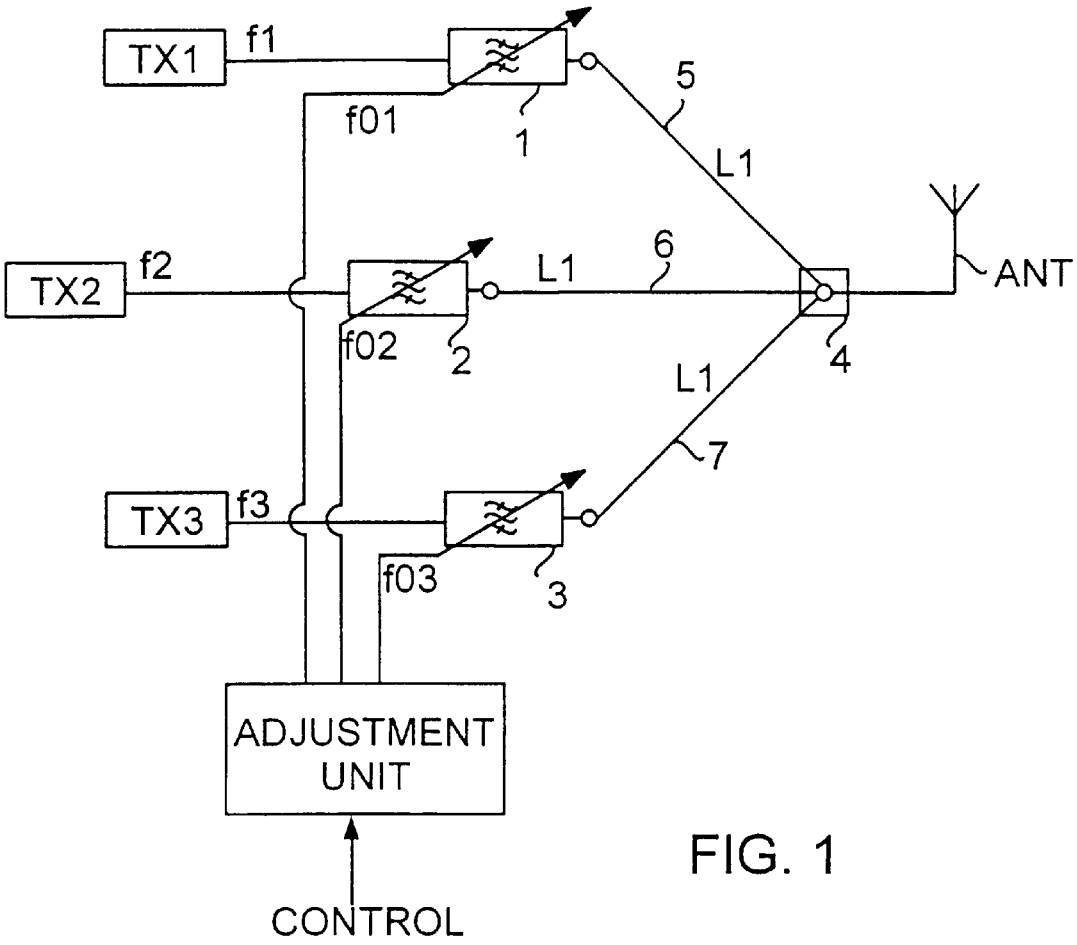
FIG. 1 is a block diagram illustrating a first preferred embodiment of a base station according to the invention.

FIG. 1 is a block diagram of a first preferred embodiment of a base station according to the invention. The summing network shown in FIG. 1 can be, for example, a summing network of a base station of the GSM mobile system, three transmission units TX1–TX3 being connected via the network to a common transmitting antenna ANT. Band-pass filters 1–3 shown in FIG. 1 are filters known per se, and their pass band can be adjusted, preferably by remote control, from the network management centre. The structure and operation of adjustable dielectric resonators, and their ceramic manufacturing materials, are described, for example, in Finnish Patent 88,227, 'Dielectric resonator.'

Each transmission unit TX1–TX3 in FIG. 1 is connected to the in-connector of the corresponding adjustable band-pass filter 1–3. The out-connectors of the band-pass filters, in turn, are connected by transmission cables 5–7 of equal length L1 to a summing member 4, in which the signals from different transmitters are summed before they are supplied to the antenna ANT of the base station.

An adjustment unit 8 generates adjustment signals f01–f03 for the band-pass filters 1–3 for adjusting the filter frequency of the filters 1–3 to be suitable to the transmission frequencies f1–f3 of the transmitters connected to the filters. This can be effected, for example, such that the adjustment unit 8 receives a control signal from the network management centre, whereby the control signal determines new set values for the adjustment unit. The adjustment unit 8 can also adjust the transmission frequency of the transmitters (not shown in the figure) in response to the control signal received from the network management centre.

As the frequency channels of the base station are changed in the invention, the adjustment unit 8 also generates adjustment signals for the summing member 4 so as to tune the summing network to correspond to the new frequency channels f1–f3 of the band-pass filters and the transmitters TX1–TX3 by adjusting the phase angle of a wave reflecting from the connectors of the summing member 4. The structure of the adjustable connectors of the summing member 4 is illustrated in FIG. 2.

Figure 2:
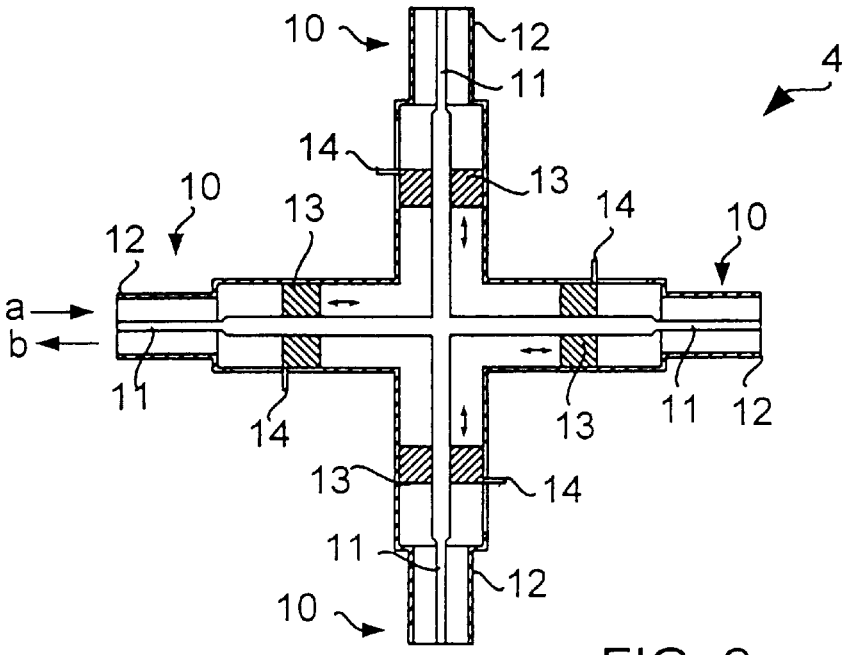
FIG. 2 illustrates a first preferred structure of a summing member according to the invention.

FIG. 2 illustrates a first preferred structure of a summing member according to the invention. The summing member 4 of FIG. 2 comprises four connectors 10, all of which are adjustable. As shown in FIG. 2, the connectors 10 are coaxial, i.e. they comprise a rod-like inner conductor 11 and a substantially tubular outer conductor 12 surrounding the inner conductor. The inner conductors 11 and, respectively, the outer conductors 12 of the connectors are interconnected so as to provide a star point. When the summing member of FIG. 2 is used in the summing network of FIG. 1, the outputs of the band-pass filters 1–3 are connected to three of the connectors 10, e.g. via coaxial cables. By a fourth connector 10 the summing member is connected to the antenna ANT of the base station, e.g. via a coaxial cable.

All connectors 10 of FIG. 2 are adjustable. To enable adjustment, a moveable part 13 that is made of low-loss dielectric material and can be moved along the inner conductor is arranged in an annular space, which is filled with air, between the inner conductor 11 and the tubular conductor 12 of each connector. The low-loss dielectric material here means material whose relative permittivity is $\epsilon r>1$ (and relative permeability $\mu r=1$), e.g. Teflon or ceramic. In connection with the connector far left in FIG. 2, propagating wave $a/\alpha°$ (signal obtained from filter) is indicated by arrow a, and reflecting wave $b/\beta°$ by arrow b. The reflection coefficient T is then:

$$T = \frac{a}{b} \Big/ \underline{\alpha^o - \beta^o}$$

The movement of the moveable part 13 from one place to another thus affects the reflection coefficient, whereby the summing network can be tuned. Since each connector 10 has its own moveable part 13, the different branches of the summing network can be tuned independently of each other.

In the summing member of FIG. 2, a slot (not shown in the figure) is provided in the tubular outer conductors 12 of the connectors 10 lengthwise of the tube. Through the slot, the moveable part 13 can be moved by a projection 14 protruding from the slot. The structure of FIG. 2 thus allows simple and sufficiently linear phase angle adjustment of a reflecting wave, the axial adjusting movement being easy to carry out by an actuator known per se in response to the control of the adjustment unit 8. In addition, the slope of the adjustment curve of the adjustment member can be easily affected by the size and the choice of material of the moveable part.

The above description and the accompanying drawings are to be understood only as illustrating the present invention. It will be obvious to a person skilled in the art that the invention can be varied and modified in many ways without deviating from the scope and spirit of the invention as disclosed in the attached claims.

We claim:

1. A base station of a radio system, comprising:

at least two transmitters;

filter means, each one of which is connected to an output of the corresponding transmitter so as to filter signals obtained from an output of the transmitter concerned and to supply the filtered signals further, said filter means being adjustable and comprising adjustment means for changing the band-pass frequency of the filter means; and a summing member with in-connectors, each one of which is connected to an output of the corresponding filter so as to receive and combine the filtered signals, and an out-connector for supplying the combined signals to antenna means of the base station, at least one of the connectors of the summing member being coaxial and comprising an elongated rod-like inner conductor and a substantially tubular outer conductor surrounding the rod-like inner conductor, and a moveable part of low-loss dielectric material or ferrimagnetic material, said movable part surrounding at least the inner conductor and being moveable lengthwise of the inner conductor;

said summing member comprising actuators responsive to the adjustment means for moving the moveable part so a to adjust the phase angle of a wave reflecting from said at least one connector and to tune the summing network of the base station in connection with a frequency change.

2. A base station according to claim 1, wherein all the connectors of the summing member are coaxial and comprise a moveable part of low-loss dielectric material or ferrimagnetic material, the part surrounding at least the inner conductor and being moveable lengthwise of the inner conductor so as to adjust the phase angle of a wave reflecting from the connector and to tune the summing network of the base station.

3. A base station of a radio system, comprising:

at least two transmitters;

filter means, each one of which is connected to an output of the corresponding transmitter so as to filter signals obtained from the output of the transmitter concerned and to supply the filtered signals further; and a summing member with in-connectors, each one of which is connected to an output of the corresponding filter so as to receive and combine the filtered signals, and an out-connector for supplying the combined signals to antenna means of the base station, all connectors of said summing member being coaxial and comprising an elongated rod-like inner conductor, a substantially tubular outer conductor surrounding the rod-like inner conductor, and a moveable part of low-loss dielectric material or ferrimagnetic material, the part surrounding at least the inner conductor and being moveable lengthwise of the inner conductor so as to adjust the phase angle of a wave reflecting from the connector and to tune the summing network of the base station.

* * * * *